United States Patent [19]

Power

[11] 4,086,950

[45] May 2, 1978

[54] DOORWAY SCREEN

[75] Inventor: H. Douglas Power, Cupertino, Calif.

[73] Assignee: Necor Corporation, Menlo Park, Calif.

[21] Appl. No.: 778,061

[22] Filed: Mar. 16, 1977

[51] Int. Cl.[2] ..... A47H 1/00

[52] U.S. Cl. ..... 160/332

[58] Field of Search ..... 160/184, 332

[56] References Cited

FOREIGN PATENT DOCUMENTS

| | | | |
|---|---|---|---|
| 1,508,336 | 11/1966 | France | 160/184 |
| 2,311,595 | 9/1973 | Germany | 160/332 |
| 2,242,984 | 3/1974 | Germany | 160/332 |

*Primary Examiner*—Peter M. Caun

*Attorney, Agent, or Firm*—Lothrop & West

[57] ABSTRACT

A doorway screen has a support extending transversely above a doorway opening. A plurality of individual flexible plastic strips or panels are at their tops secured to and suspended from the support. The strips or panels are formed to have in horizontal cross-section a relatively thin, straight central portion merging at the end edges with relatively thick bulbous or enlarged bead ends. The strips or panels are disposed to overlap each other with each of the end edges of one strip in abutment with the straight portion of an adjacent strip to define discrete pockets between adjacent end edges.

2 Claims, 4 Drawing Figures

DOORWAY SCREEN

BRIEF SUMMARY OF THE INVENTION

In order to permit ready access by machines and personnel through a doorway yet to inhibit air flow, sound transmission and the like through the doorway opening, I have provided a number of strips hanging from a transverse support above the doorway opening and sometimes extending beyond the opening. The strips are preferably of a thin, transparent plastic, such as polyvinyl chloride, and are particularly configured so that when suspended vertically they have in a horizontal cross-section a relatively thin, straight, central section. At both ends they are enlarged to afford bulbous or bead-like end edges.

The individual strips when hung are preferably overlapped substantially so that the bead edges or end edges or bead ends of one strip come into contact or abutment with the central flat portion of the adjacent strips and so enclose a discrete pocket. The arrangement is such that while a person or a machine can readily brush by the hanging strips by thrusting them aside or parting them, nevertheless when undisturbed the strips hang by gravity in the abutting relationship described.

The character of the strips is such as to preclude normal air drafts going through the doorway, although the strips will yield to extraordinarily strong winds. The strips are well reinforced at the edges against mechanical abrasion and tearing, and the discrete pockets serve not only as thermal insulators because of the quiescent air therein, but also and for a similar reason serve as acoustic barriers.

In normal installation, the upper ends of the so positioned strips are clamped between a pair of horizontally or transversely extending metal shapes by fasteners such as bolts and nuts. The bolts pass not only through holes in the metal shapes, but likewise pass through registering holes in the individual strips. Conveniently, the end strips near the door frame can be colored so as to direct attention to the boundaries of the doorway opening.

DETAILED DESCRIPTION

Figure 2:
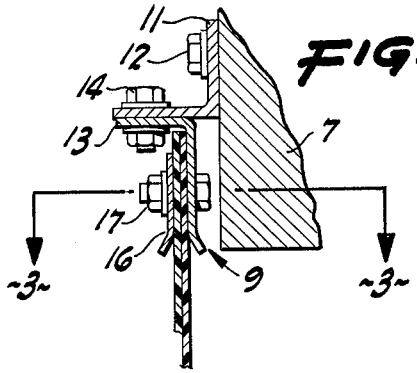
FIG. 2 is a cross-section to an enlarged scale, the plane of section being on the line 2—2 of FIG. 1 and portions of the structure being broken away.
Figure 1:
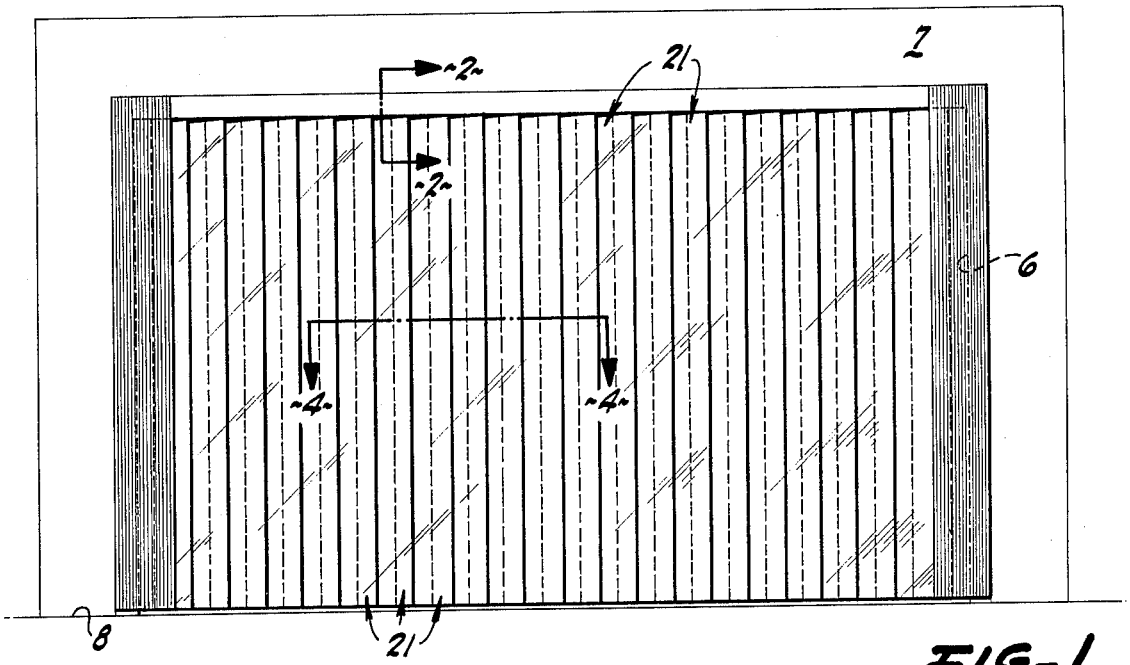
FIG. 1 is a front elevation of a wall having a doorway opening therein equipped with a doorway screen pursuant to the invention.
Figure 3:
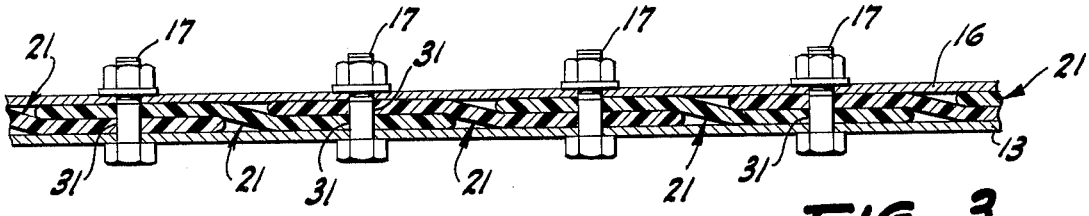
FIG. 3 is a cross-section substantially to the scale of FIG. 2, the plane of section being indicated by the line 3—3 of FIG. 2 and certain portions being broken away.

The doorway screen can be adapted to various openings in addition to doorways and is for the protected separation of any adjacent spaces while allowing for ready passage of people and machines from one side of the screen to the other. There is described herein a normal or typical doorway installation. In this instance there is a doorway opening 6 in a wall 7, the doorway opening being of the standard rectangular kind having a floor 8 at the bottom and being bounded by any appropriate frame, not detailed. The doorway screen or curtain pursuant to this invention includes a support 9 or transverse header preferably inclusive of an angle bracket 11 having fastenings 12 securing it to the wall 7. The support carries a metal shape such as an angle 13 held to extend transversely or horizontally above the doorway opening by means of suitable fasteners 14. The support 9 in addition to the angle 13 also includes another transversely extending metal shape 16, usually a strap, adapted to be secured relative to the shape 13 by through fastenings 17 arranged at appropriate intervals along the support 9.

Figure 4:
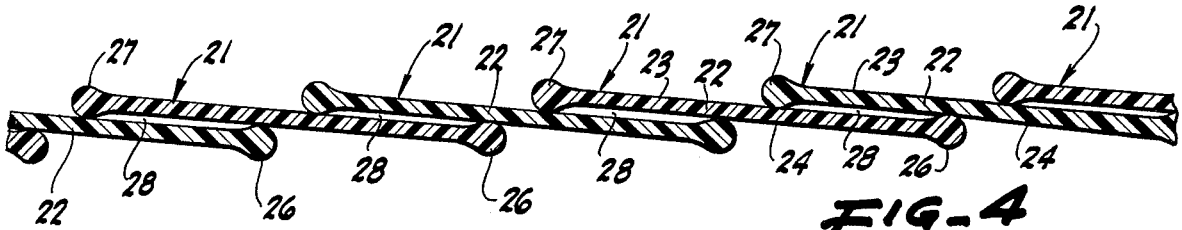
FIG. 4 is an enlarged cross-section, the plane of which is indicated by the line 4—4 of FIG. 1, and certain portions being broken away.

Disposed between the members or shapes 13 and 16 are a number of strips or panels 21. At their upper ends these are partly protected by the overhang of the angle 13. Each of the strips or panels is formed, as shown in FIG. 4, of flexible plastic material such as polyvinyl chloride and is conveniently although not necessarily made translucent or transparent. Each strip is generally the same as its neighboring strips, and in one instance is conveniently about one foot in transverse dimension or width. Each strip in cross-section at its central portion 22 is relatively straight and flat. The central portion is defined between a pair of planar surfaces 23 and 24 extending for most but not all of the width of the strip. Adjacent both ends (or in some cases at one end only), the end or edge portion is enlarged and has a greater thickness than the central portion. This affords a bead or bulbous end edge 26 on one end and 27 on the other, both ends usually being substantially identical. The enlarged end edges or bead ends merge smoothly into the central portion and often partake of particular cross-sectional configurations such as teardrop, parabolic or the like. The strips are usually uniform throughout their length and so can readily be manufactured by extrusion.

In the described installation, strips of appropriate length are supported from their upper ends to depend by gravity. The strips are preferably arranged between the shapes 13 and 16 in a staggered, overlapping relationship. While various extents of overlap may be provided and while various numbers or layers of strips may also be provided, in a simple and typical arrangement the spacing and disposition are as shown in FIG. 4. In this array the individual strips are overlapped so that the bulbous end 26 of one strip rests against or abuts a portion of the intermediate, thin part of the adjacent strip. Also, the adjacent strip at its bulbous end 27 rests against the central straight portion of the one strip. By this arrangement there is provided virtually a multiple thickness curtain but also, and perhaps more important, there is defined between adjacent strips a discrete pocket 28 or closed volume all along the length (or height) of the strips.

To support the strips and maintain them in the desired array, fasteners such as nuts and bolts 29 cooperate with openings in the respective metallic shapes and also with corresponding apertures 31 in the individual strips. While the fasteners 29 need not be tightened in order to sustain the weight of the strips, they are preferably tightened substantially to deform or squeeze or clamp the ends of the strips so as virtually to close the upper ends of the discrete pockets 28. Although the pockets are open at the bottom, they do not assist in vertical air circulation, but rather act as closed volumes against circulation of the enclosed air. The pockets not only serve as excellent thermal barriers or insulators, but also have a similar effect on the transmission of sound from one side of the curtain to the other.

In some cases there is a variation. The end panels 32 and 33 which may slightly overlap the frame of the doorway are of a color such as red to serve as a visual warning of the boundaries of the doorway opening.

In practice it has been found that the normally relatively smooth surface of the panels makes them move easily with respect to each other when machinery is moved or people walk between them, although because of their weight and increased resistance to sliding over each other at the enlarged edges they resist displacement by ordinary air flow between the opposite sides. Extreme winds or the like will, of course, deflect the panels. In some instances several successive panel structures are utilized so that they are not simultaneously disrupted. Since the major part of the area of the panels is not in contact and since the contact between adjacent panels is primarily linear just at the bead or edge area, there is little difficulty in separating the panels despite static electrical attraction and despite cold and wet conditions when moisture gets on the beads and may tend to freeze thereon. Separation of the panels even under those adverse circumstances is simple. The enlarged and beaded edges serve as mechanical reinforcements and, being smooth and rounded, cannot cause any injury to mechanism or people passing between them. If occasionally a strip or a portion of the curtain should be damaged, it is easily removed and replaced with a sound strip.

There has thus been provided an excellent barrier to preclude unwanted movement from one side of the curtain to the other and a device which yields readily to people or machines passing through the opening. There is provided a thermal and sound barrier in an attractive, effective and economical fashion and one that is properly operable despite wide changes in ambient conditions.

I claim:

1. A doorway screen comprising a transverse header, a plurality of elongated flexible strips, said strips each having in transverse cross-section a relatively thin, relatively wide and substantially flat central portion and a pair of relatively thick, relatively narrow bead ends merging smoothly with said central portion whereby said bead ends when hanging freely are transversely slidable across and away from the central portion of adjacent similar strips, means for securing said strips to said header including continuous means for clamping a plurality of said strips in overlapping relationship at the top against relative transverse displacement with respect to each other and with said bead ends of alternate strips lying against said central portion of an intervening one of said strips and spaced transversely apart and defining between them substantially enclosed air pockets parallel to said bead ends, said air pockets being substantially closed at the top by said clamping means.

2. A device as in claim 1 in which said air pockets when hanging freely are substantially closed on both sides and at the top.

* * * * *